US010161575B2

(12) United States Patent
Xiong et al.

(10) Patent No.: US 10,161,575 B2
(45) Date of Patent: Dec. 25, 2018

(54) SOLID STATE LIGHTING DEVICE AND LUMINAIRE

(71) Applicant: PHILIPS LIGHTING HOLDING B.V., Eindhoven (NL)

(72) Inventors: Yan Xiong, Eindhoven (NL); Lin Wang, Eindhoven (NL); Chuan Yuan, Eindhoven (NL); Qianying Dai, Eindhoven (NL); Hao Jiang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/570,350

(22) PCT Filed: Apr. 22, 2016

(86) PCT No.: PCT/EP2016/059082

§ 371 (c)(1),
(2) Date: Oct. 29, 2017

(87) PCT Pub. No.: WO2016/173951

PCT Pub. Date: Nov. 3, 2016

(65) Prior Publication Data

US 2018/0142843 A1 May 24, 2018

(30) Foreign Application Priority Data

Apr. 30, 2015 (CN) ..... PCT/CN2015/077970
Jul. 9, 2015 (EP) ..... 15176069

(51) Int. Cl.
*F21K 9/65* (2016.01)
*F21S 8/00* (2006.01)
(Continued)

(52) U.S. Cl.
CPC ..... *F21K 9/65* (2016.08); *F21S 8/00* (2013.01); *F21V 14/06* (2013.01); *F21V 21/14* (2013.01);
(Continued)

(58) Field of Classification Search
CPC ..... F21V 21/14; F21V 14/02; F21K 9/65; F21K 9/23; F21Y 2107/30; F21Y 2115/10; F21W 2131/10
(Continued)

(56) References Cited

U.S. PATENT DOCUMENTS 4,363,084 A * 12/1982 Dimiceli ..... B60Q 7/00 362/249.01
7,810,968 B1 * 10/2010 Walker ..... F21V 21/30 362/431
(Continued)

FOREIGN PATENT DOCUMENTS

CN 201314520 Y 9/2009
CN 102147091 B 5/2012
(Continued)

*Primary Examiner* — Laura Tso
(74) *Attorney, Agent, or Firm* — Akarsh P. Belagodu

(57) ABSTRACT

A lamp (10) for replacement of a HPS or HID lamp, is disclosed that comprises a support element (13) including a mounting shaft (15) extending therefrom, said mounting shaft being substantially parallel and having lateral displacement relative to a central axis of the lamp and a plurality of modules (20) each comprising a heat spreading element (23) wherein at least one module is mounted on the mounting shaft and is rotatable about the mounting shaft such that said at least one module can be pivoted between a first orientation in which the modules cooperate to define a closed structure; and a second orientation in which the at least one module is pivoted away from at least one neighboring module to define an opened structure. The lamp further comprises a plurality of sets of solid state lighting elements (30) wherein each set
(Continued)

is mounted on an outer surface (21) of one of said modules, and a holder (11) for holding the support element (13), wherein the holder comprises a lamp cap (12) to connect the lamp (10) to a power source, wherein the lamp cap is compatible with a socket for the HPS or HID lamp to be replaced. A luminaire including such a lamp is also disclosed.

14 Claims, 7 Drawing Sheets

(51) Int. Cl.

| | |
|---|---|
| ***F21V 14/06*** | (2006.01) |
| ***F21V 21/14*** | (2006.01) |
| *F21V 14/02* | (2006.01) |
| *F21W 131/10* | (2006.01) |
| *F21Y 101/00* | (2016.01) |
| *F21K 9/23* | (2016.01) |
| *F21Y 115/10* | (2016.01) |
| *F21Y 107/30* | (2016.01) |

(52) U.S. Cl.
CPC ..... *F21K 9/23* (2016.08); *F21V 14/02* (2013.01); *F21W 2131/10* (2013.01); *F21Y 2101/00* (2013.01); *F21Y 2107/30* (2016.08); *F21Y 2115/10* (2016.08)

(58) Field of Classification Search
USPC ... 362/249.09, 249.1, 249.07, 285, 287, 188
See application file for complete search history.

(56) References Cited

U.S. PATENT DOCUMENTS

| | | | | |
|---|---|---|---|---|
| 7,866,837 | B2 | 1/2011 | Ho | |
| 8,109,660 | B2 * | 2/2012 | Hochstein | F21K 9/00 362/373 |
| 8,123,378 | B1 * | 2/2012 | Ruberg | F21S 8/088 362/249.02 |
| 8,469,552 | B2 | 6/2013 | Moeller | |
| 8,864,346 | B2 | 6/2014 | Chinniah et al. | |
| 9,222,633 | B2 * | 12/2015 | Inskeep | F21S 9/02 |
| 2005/0099810 | A1 | 5/2005 | Tasson et al. | |
| 2012/0039077 | A1 | 2/2012 | Householder | |
| 2012/0057333 | A1 * | 3/2012 | Bhardwaj | F21L 13/06 362/183 |
| 2013/0128565 | A1 | 5/2013 | Cugini et al. | |
| 2014/0016326 | A1 | 1/2014 | Dieker et al. | |
| 2014/0347863 | A1 | 11/2014 | Wu | |

FOREIGN PATENT DOCUMENTS

| | | | |
|---|---|---|---|
| DE | 102013204041 | A1 | 9/2014 |
| DE | 202014000430 | U1 | 4/2015 |
| JP | 2004296249 | A | 10/2004 |
| KR | 20090017294 | A | 12/2009 |
| KR | 968270 | B1 | 7/2010 |
| KR | 1020100076289 | A | 7/2010 |
| KR | 20120045566 | A | 5/2012 |
| KR | 1206083 | B1 | 11/2012 |
| WO | WO2013007815 | A1 | 1/2013 |
| WO | WO2013047929 | A1 | 4/2013 |
| WO | WO2014121071 | A1 | 8/2014 |
| WO | WO2014180689 | A1 | 11/2014 |

* cited by examiner

SOLID STATE LIGHTING DEVICE AND LUMINAIRE

CROSS-REFERENCE TO PRIOR APPLICATIONS

This application is the U.S. National Phase application under 35 U.S.C. § 371 of International Application No. PCT/EP2016/059082, filed on Apr. 22, 2016, which claims the benefit of European Patent Application No. 15176069.1, filed on Jul. 9, 2015 and Chinese Patent Application No. PCT/CN2015/077970, filed Apr. 30, 2015. These applications are hereby incorporated by reference herein.

FIELD OF THE INVENTION

The present invention relates to a solid state lighting (SSL) device, in particular to a lamp as a HPS (High Pressure Sodium) replacement lamp or HID (High Intensity Discharge) replacement lamp.

The present invention further relates to a luminaire comprising such a solid state lighting device.

BACKGROUND OF THE INVENTION

Modern society is witnessing a shift towards solid state lighting applications such as LED applications. Such applications have improved longevity and superior energy consumption characteristics compared to traditional light sources such as incandescent and halogen light sources. One such an application domain is outdoor lighting, where traditionally HPS and HIS lamps have been used to illuminate outdoor areas, e.g. public outdoor areas such as streets, squares, motorways and so on.

In some jurisdictions such as the US, such lighting devices are required to produce a lighting distribution of a particular shape at least in the horizontal plane, such as the Dark Sky standard in the US, which defines a number of different light distributions (e.g. Type I-V light distributions). These different light distributions for instance are to facilitate meeting different residents' requirements regarding outdoor light distributions in the vicinity of their place of residency. In order to achieve the different light distributions, luminaries are typically fitted with reflectors or specially designed optical structures.

For such outdoor lighting applications, there usually are no standards to control glare experienced by users of the outdoor areas, e.g. drivers and pedestrians. However, with the influx of SSL devices that tend to generate different types of luminous distributions compared to traditional counterparts such as HPS or HID lamps, there is an increasing demand for glare control for SSL devices for outdoor lighting applications, for instance to provide more comfortable light distributions for pedestrians, and safer light distributions for drivers. This may be achieved by providing optical elements in luminaries, e.g. over the SSL elements to shape their luminous output in a vertical plane. However, such solutions typically need to be tailored to specific applications or locations as the optical shaping of the luminous distribution typically is a function of the orientation in which the SSL devices are fitted in the luminaries.

There is therefore a need for a SSL device for outdoor lighting applications that can be configured to produce different light distributions, e.g. at least some of the light distributions of the US Dark Sky standard, and that provides better glare control.

US2013/0128565A1 discloses light fixture comprising lighting panels hingedly connected and reconfigurable between area lighting and spot lighting. However, it is not for replacement of HPS or HID lamps.

SUMMARY OF THE INVENTION

The present invention seeks to provide a lamp that addresses at least some of these needs.

The present invention further seeks to provide an outdoor luminaire comprising such a lamp.

The invention is defined by the claims.

According to an aspect, there is provided a lamp for replacement of a HPS or HID lamp, comprising a support element including a mounting shaft extending therefrom, said mounting shaft being substantially parallel and having lateral displacement relative to a central axis of the lamp; a plurality of modules each comprising a heat spreading element; a plurality of sets of solid state lighting elements, wherein each set is mounted on an outer surface of one of said modules; wherein at least one module is mounted on the mounting shaft and is rotatable about the mounting shaft such that said at least one module can be pivoted between a first orientation in which the modules cooperate to define a closed structure with an inner volume, which acts as a chimney structure through which a gas or a gas mixture can flow along the direction of the central axis of the lamp; and a second orientation in which the at least one module is pivoted away from at least one neighboring module to define an opened structure; and a holder for holding the support element, said holder comprising a lamp cap to connect the lamp to a power source. The lamp cap is compatible with a socket for the HPS or HID lamp to be replaced.

The lamp of the present invention can be easily reconfigured to generate a different light distribution in a horizontal plane by altering the orientation, i.e. pivoting of the at least one module rotatably mounted on the mounting shaft. This changes the orientation of the SSL elements carried by the at least module, thus causing a change in the luminous distribution produced by the lamp without requiring one or more reflectors to reshape the luminous distribution. The lamp of the present invention may be manufactured in a cost-effective manner as the same tooling may be used to manufacture the various modules of the lamp.

In the second orientation, the outer surface of the at least one module pivoted away from a neighboring module may face the same direction of the outer surface of the neighboring module in order to align the luminous distribution of the at least one module with the light distribution produced by the SSL elements on the neighboring module.

The least one module mounted on the mounting shaft may have an edge portion comprising a mounting member mounted on the mounting shaft. This facilitates straightforward assembly of the lamp and allows for a maximized difference in the main direction of the respective luminous distributions produced by the SSL elements of the at least one module between the opened and closed orientation as pivoting the at least module around its edge ensures maximal displacement of the at least one module.

In an embodiment, a pair of modules is mounted on the mounting shaft such that the respective edge portions of said pair are facing each other. This increases the reconfigurability of the lamp.

The outer surfaces may be curved surfaces such that the closed structure has a substantially cylindrical shape. Consequently, the modules cooperate in the closed structure to form a chimney structure delimited by the modules. In other words, a void or cavity, for instance aligned with the central axis, may be delimited by the modules, which has the advantage of particularly effective thermal management of the SSL elements on the modules due to the efficient heat transfer between the heat spreading elements and the gas or gas mixture, e.g. air, in the chimney structure.

The lamp may further comprise a locking element for locking the at least one module mounted on the mounting shaft in the first or second orientation to secure the at least one module, thus preventing accidental reorientation of the at least one module.

For example, the mounting shaft may comprise a threaded end portion; and the locking element may comprise a nut or screw for engaging with the threaded end portion to implement such a locking element.

In an embodiment, the support element comprises a pair of mounting shafts, wherein at least one module is rotatably mounted on each mounting shaft. This further increases the reconfigurability of the lamp. The mounting shafts may be offset by a same amount in opposite directions to remain the symmetry of the lamp.

In a particularly advantageous embodiment, each module further comprises an optical element adjustably mounted over the set of solid state lighting elements, wherein the optical element can be adjusted between a first position and a second position, said optical element comprising a first lens portion for directing the luminous output of the set of solid state lighting elements in a first direction in said first position; and a second lens portion spatially separated from the first lens portion for directing the luminous output of the set of solid state lighting elements in a second direction different to the first direction in said second position. This optical element for instance facilitates the shaping of the luminous distributions produced by the respective sets of SSL elements in a vertical direction, thereby facilitating improved glare control as the luminous distributions can be easily adjusted as a function of the mounting position of the lamp in a luminaire.

The optical element may be slidably mounted over the set of solid state lighting elements such that its position can be adjusted in a particularly easy manner.

At least one of the first lens portion and the second lens portion may be an asymmetric lens portion to create (at least) three zones in its luminous distribution in which the risk of glare in some of these regions is reduced.

For example, the asymmetric lens portion may be shaped to generate a first luminous distribution portion and a second luminous distribution portion separate from the first luminous distribution portion by a third luminous distribution portion of lower intensity than the first and second luminous distribution portions. A first luminous distribution portion or zone may be generated in which glare for a vehicle driver is reduced, a second luminous distribution portion or zone may be generated in which pedestrian glare is reduced and a third luminous distribution portion zone may be generated in which a luminaire is seldom directly observed in which light output may be concentrated to achieve effective illumination of an outdoor area such as a street.

According to another aspect, there is provided a luminaire comprising the lamp of any of the above embodiments. Such a luminaire is particularly suitable as a luminaire for outdoor lighting applications.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
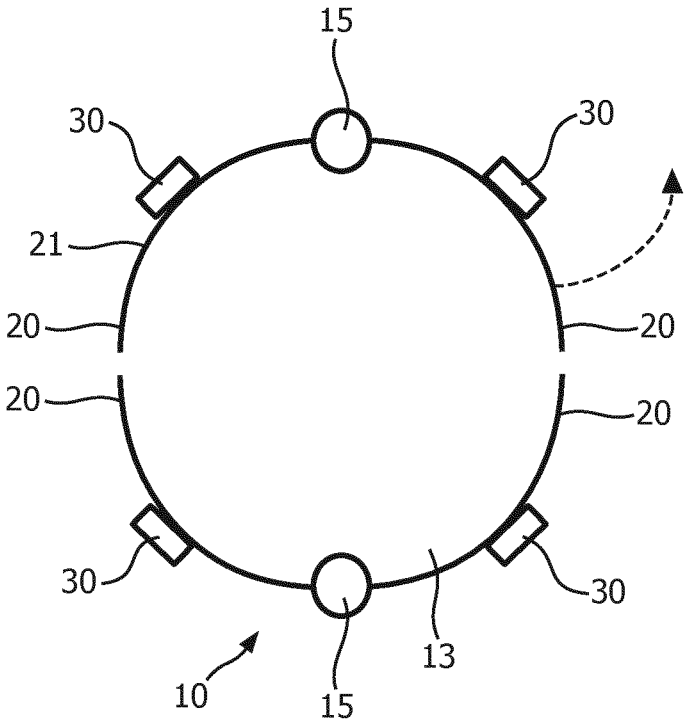
FIG. 1 schematically depicts a top view of a configuration of a lamp according to an embodiment.

It should be understood that the Figures are merely schematic and are not drawn to scale. It should also be understood that the same reference numerals are used throughout the Figures to indicate the same or similar parts.

FIG. 1 schematically depicts a top view of a lamp 10 having four modules 20, each having an outer surface 21 onto which a set of SSL elements 30 is mounted. In the context of the present application, a set of SSL elements 30 contains at least one SSL element 30, but may contain any suitable number of SSL elements 30. Any suitable type of SSL element 30, e.g. any suitable type of LED, may be contemplated. The SSL elements 30 may be mounted on the outer surface 21 in any suitable manner, e.g. directly on the outer surface 21 or may be mounted on a carrier (not shown), which carrier is mounted on the outer surface 21. Any suitable carrier, e.g. a chip or printed circuit board, may be contemplated.

The modules 20 typically comprise or act as a heat spreading portion for the heat generated by the SSL elements 30 to ensure that the operating temperature of the SSL elements is maintained within a certain operating window. This is to ensure that the SSL elements 30 have the desired optical performance and to extend the lifetime of the SSL elements 30, as is well-known per se. To this end, the modules 20 may comprise or be made of a heat conducting material. Metal or metal alloys are particularly suitable materials for this purpose. For example, the modules 20 may be made of aluminium, which is cheap and facilitates the manufacture of the modules 20 in various shapes.

The lamp 10 further comprises one or more mounting shafts 15 onto which at least some of the modules 20 are rotatably mounted, as indicated by the dashed arrow. The mounting shaft 15 and a module mounted thereon may cooperate to form a hinge, such that the module 20 can pivot from a closed to an opened orientation, similar to a door hinged against a door frame. In FIG. 1, all modules 20 are in the closed orientation such that the combined SSL elements 30 generate a 360° luminous distribution around the lamp 10. In this closed configuration, the respective horizontal edges of the outer surfaces 21 of the modules 20 may abut each other such that the modules 20 cooperate to delimit an inner volume 13 of the lamp 10. The inner volume 13 may act as a chimney structure through which a gas or a gas mixture such as air can flow. This facilitates the heat transfer from the heat spreading elements to the gas or gas mixture and improves the cooling efficiency of the SSL elements 30.

Figure 2:
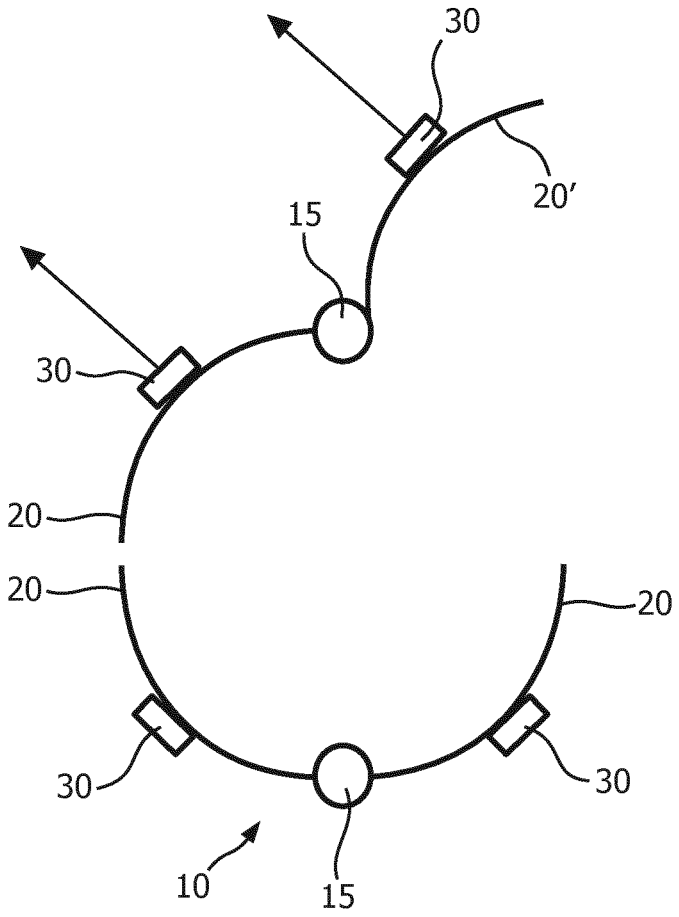
FIG. 2 schematically depicts a top view of another configuration of a lamp according to an embodiment.
Figure 3:
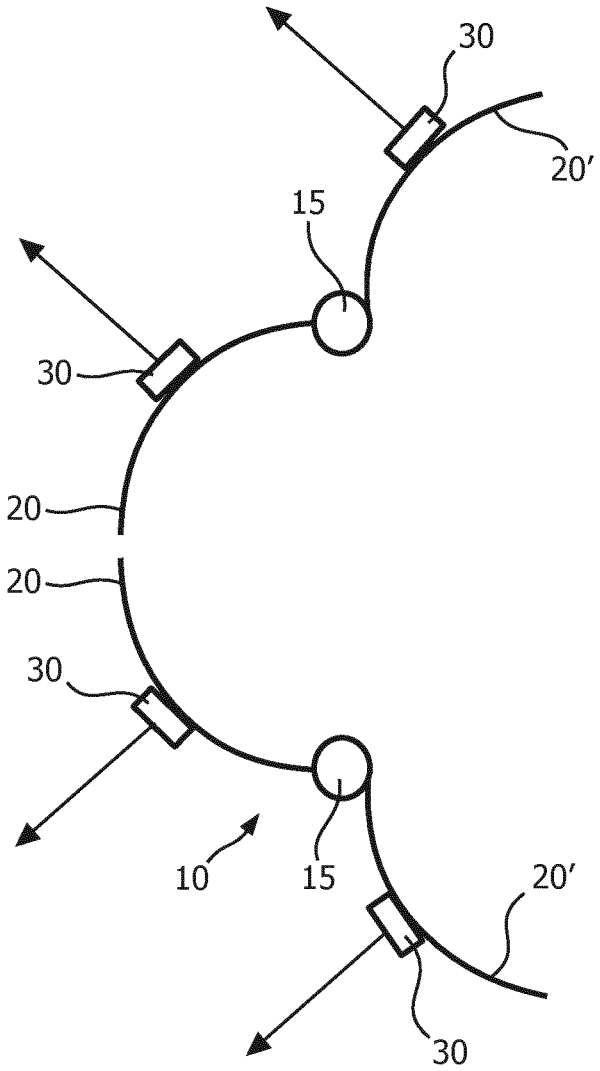
FIG. 3 schematically depicts a top view of yet another configuration of a lamp according to an embodiment.

By pivoting a rotatably mounted module 20 from a closed to an opened orientation, the luminous distribution produced by the lamp 10 may be reconfigured. Examples of such reconfigured lamp 10 are schematically depicted in FIG. 2 and FIG. 3 respectively, in which a single module (FIG. 2) and two modules (FIG. 3) are respectively pivoted to opened positions. The pivoted modules are labeled 20' to indicate their adjusted positions. In an embodiment, a module 20' may be pivoted into an opened position in which the optical axis of the luminous distribution generated by its SSL elements 30 has the same direction as the optical axis of the luminous distribution generated by the SSL elements 30 of the neighboring module 20 although it should be understood that it is equally feasible to pivot a module 20' into an opened orientation in which the optical axis of the luminous distribution generated by its SSL elements 30 is oriented under a non-zero angle relative to the optical axis of the luminous distribution generated by the SSL elements 30 of the neighboring module 20. It will be readily understood by the skilled person that the orientation of the pivoted module 20' is typically purposively set to generate a particular luminous distribution with the lamp 10.

Figure 4:
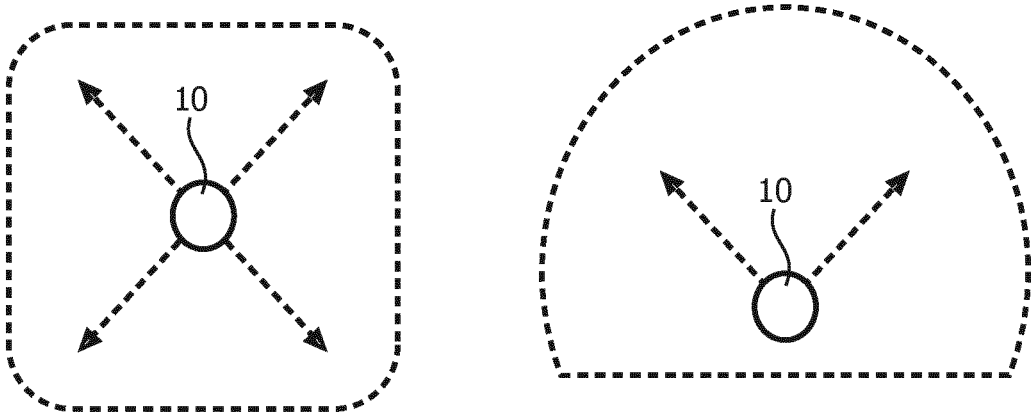
FIG. 4 schematically depicts examples of lighting distributions that can be achieved by reconfiguring the lamp according to at least some embodiments.

FIG. 4 schematically depicts two of such luminous distributions, as indicated by the dashed borders. The dashed arrows indicate the respective orientations of the optical axes of the sets of SSL elements 30 on the modules 20. The left distribution for instance may be generated by a lamp 10 comprising four modules 20 in a closed orientation, e.g. as shown in FIG. 1. The right distribution for instance may be generated by a lamp 10 comprising four modules 20, two in a closed orientation and two in an opened orientation, e.g. as shown in FIG. 3. The left luminous distribution may be a Type V distribution of the Dark Sky standard and the right distribution may be a Type III distribution of the Dark Sky standard although it should be understood that the present invention is not limited to these particular luminous distributions; any suitable distribution, e.g. Type, Type II or Type IV distributions of the Dark Sky standard or distributions other than Dark Sky mandated distributions may be generated by shaping the modules 20 and adjusting the orientation of the one or more modules 20 that are rotatably mounted on a mounting shaft 15 of the lamp 10.

In FIG. 1-3, the outer surfaces 21 of the modules 20 are curved surfaces such that the modules 20 cooperate in the closed configuration to form a cylindrical structure but it should be understood that the outer surfaces 21 may take any suitable shape, e.g. a planar surface or a multi-faceted surface.

Figure 5:
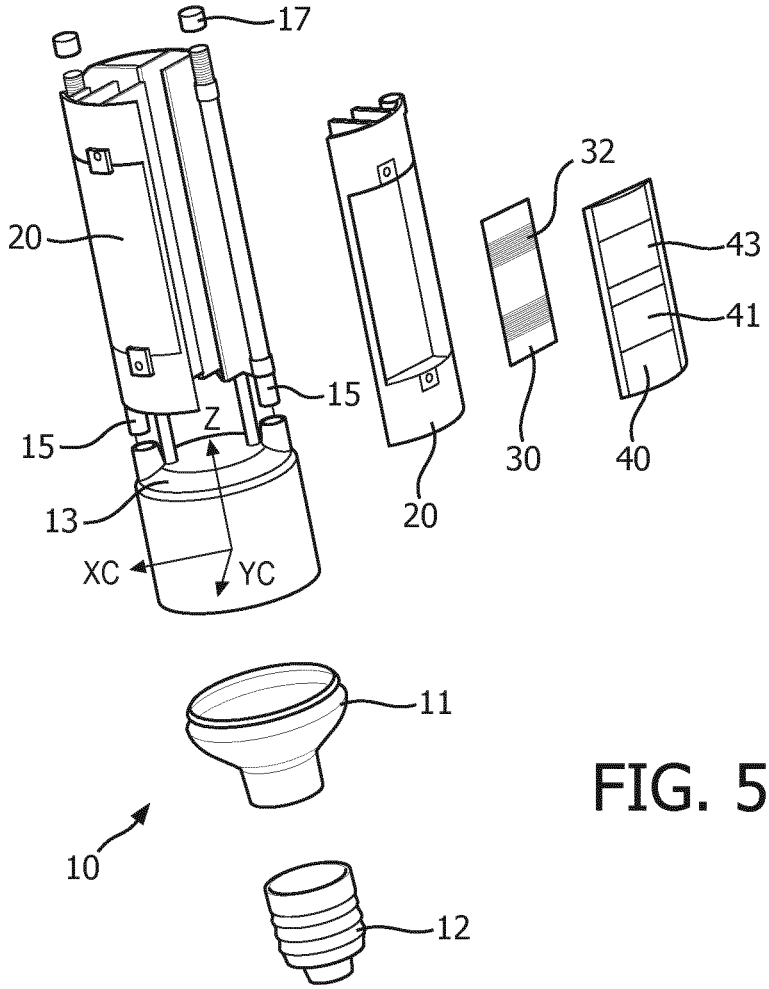
FIG. 5 schematically depicts an exploded view of a lamp according to an embodiment.

FIG. 5 schematically depicts an exploded view of an embodiment of the lamp 10. The lamp 10 may be a replacement for a HID or HPS lamp. In FIG. 5, the lamp 10 comprises four modules 20 mounted on a pair of mounting shafts 15 by way of non-limiting example; it will be understood that any suitable number of modules 20 and mounting shafts 15 may be contemplated. The lamp 10 according to this embodiment comprises a holder 11 including an electrical interface 12, e.g. a fitting or a lamp cap, to connect the lamp 10 to a power source. The holder 11 may comprise an electrically insulating portion for insulating the electrically conductive electrical interface 12, e.g. a metal electrical interface 12 from the remainder of the lamp 10. The holder 11 is adapted to receive a support element 13 from which the one or more mounting shafts 15 extend. Each mounting shaft 15 is laterally offset relative to a central axis of the lamp 10. In case of more than one mounting shaft 15, e.g. a pair of mounting shafts 15 as shown in FIG. 5, each mounting shaft 15 is preferably offset by the same amount, e.g. to maintain the symmetry of the lamp 10. The support element 13 and mounting shaft(s) 15 extending therefrom are preferably made of the same material such that they can be manufactured in a straightforward manner. The material may be a plastics material such as an electrically insulating plastics material such that the support element 13 and mounting shaft(s) 15 may be manufactured cheaply, e.g. by casting or molding.

At least some of the modules 20 may be rotatably mounted on a mounting shaft 15, as previously explained. In an embodiment, half of all modules 20 are rotatably mounted in this manner. In an alternative embodiment, all of the modules 20 are rotatably mounted in this manner. The SSL elements 30 are mounted on a carrier 32, e.g. a chip of printed circuit board, which is mounted on the outer surface 21 of a receiving module 20. In selected embodiments, an optical element 40 may be slidably mounted over the SSL elements 30 on a module 20 such that the luminous output of the SSL elements 30 may be shaped by a first lens portion 41 or a second lens portion 43 depending on the position of the optical element 40, as will be explained in more detail below.

The lamp 10 may further comprise one or more locking elements 17 for locking a rotatably mounted module 20 in a chosen orientation, e.g. an opened or closed orientation, to prevent the accidental and unwanted reorientation of the rotatably mounted module 20. Any suitable locking element, e.g. a clamp or clip, may be used for this purpose. In an embodiment, the mounting shaft 15 comprises a threaded end portion and the locking element 17 comprises a nut or screw for engaging with the threaded end portion such that the module 20 rotatably mounted on the mounting shaft 15 can be fixated in the chosen orientation by engaging the nut or screw with the threaded end portion.

Figure 6:
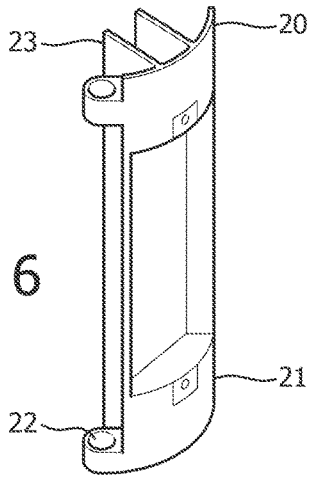
FIG. 6 schematically depicts a perspective view of an aspect of a module of a lamp according to an embodiment.

FIG. 6 schematically depicts a perspective view of a module 20 configured as a heat sink element. The module 20 comprises an outer surface 21 for receiving the set of SSL elements 30 as previously explained. The outer surface 21 may take any suitable shape, here a curved shape. An edge portion of the module 20, e.g. of the outer surface 21, comprises one or more mounting members 22 for mounting the module 20 on a mounting shaft 15. For example, a mounting member 22 may delimit a cylindrical aperture for receiving the mounting shaft 15. The module 20 further comprises one or more fins 23 extending from a main body having the outer surface 21 for increasing the surface area of the heat sink element to increase the heat transfer capacity of the heat sink portion, as is well known per se.

Figure 7:
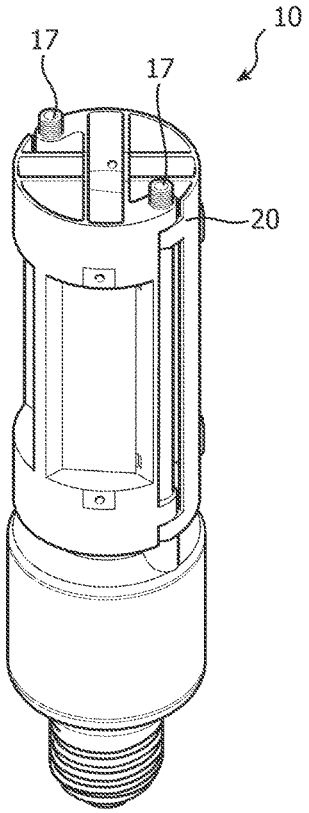
FIG. 7 schematically depicts a perspective view of a closed configuration of a lamp according to an embodiment including the module of FIG. 6.
Figure 8:
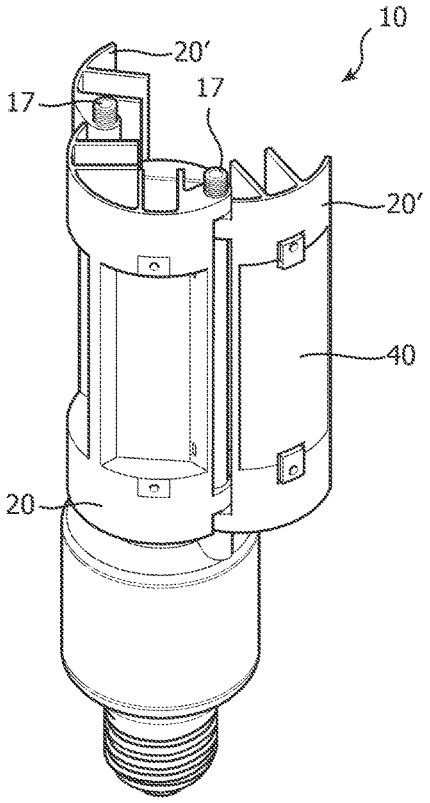
FIG. 8 schematically depicts a perspective view of an opened configuration of a lamp according to an embodiment including the module of FIG. 6.

FIGS. 7 and 8 schematically depict the lamp 10 of FIG. 5 in a closed configuration and opened configuration respectively. In FIG. 8, the reoriented modules are labeled 20' for the sake of clarity. Locking elements 17 are engaged to maintain the rotatably mounted modules in their closed orientations 20 and their opened orientations 20' respectively to prevent accidental and undesirable changes to the luminous distribution produced by the lamp 10 as previously explained. FIG. 8 also shows the optical element 40 over the set of SSL elements 30 (not visible in FIG. 8) of a module 20, which optical element will be explained in more detail below.

In use, the lamp 10 may be mounted in any suitable orientation, e.g. with the holder 11 above or below the modules 20. One of the lens portions 41 and 43 of the optical element 40 may be positioned over the SSL elements 30 of a module 20 as a function of the orientation of the lamp 10 in a luminaire to ensure that the lamp 10 can produce the desired luminous distribution independent of the mounting orientation of the lamp 10 in a luminaire.

Figure 9:
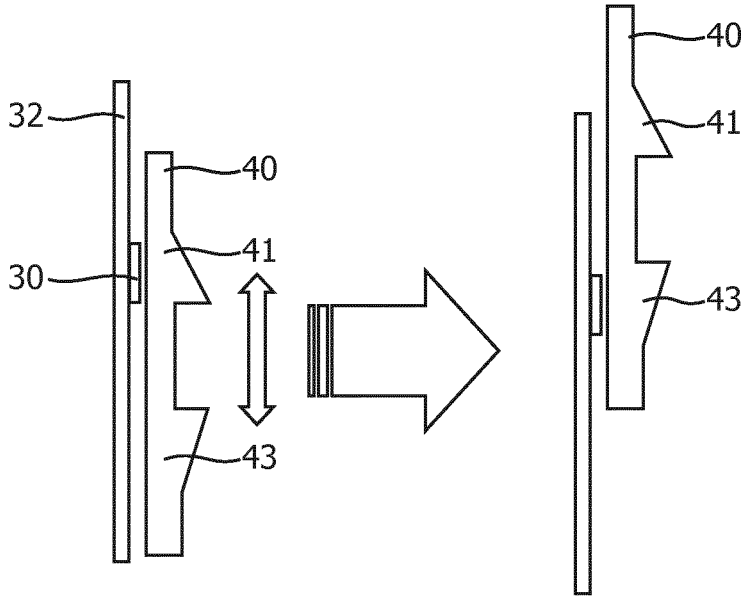
FIG. 9 schematically depicts an optical device of a lamp according to an embodiment in more detail.

An example embodiment of the optical device 40 is schematically depicted in FIG. 9. The optical device 40 comprises a first lens portion 41 and a second lens portion 43 that is spatially separated from the first lens portion 41. The optical element 40 is adjustably mounted, e.g. slidably mounted, over the set of solid state lighting elements 30, here shown to be mounted on a carrier 32 by way of non-limiting example, such that the optical element 40 can be adjusted between a first position and a second position. In the first position, shown as the left configuration in FIG. 9, the first lens portion 41 is positioned over the SSL elements 30 such that the luminous output of the SSL elements 30 is redirected in a first direction by the first lens portion 41. In the second position, shown as the right configuration in FIG. 9, the second lens portion 43 is positioned over the SSL elements 30 such that the luminous output of the SSL elements 30 is redirected in a second direction by the second lens portion 43. The second direction may be an inverse or mirror image of the first direction, as will be explained in more detail below.

The first lens portion 41 and the second lens portion 43 may be mirror images of each other such that when the lamp 10 is mounted in a luminaire with the holder 11 below the modules 20, one of the first lens portion 41 and the second lens portion 43 may be placed over the set of SSL elements 30 to obtain the desired luminous distribution, whereas when the lamp 10 is mounted in a luminaire with the holder 11 above the modules 20, the other of the first lens portion 41 and the second lens portion 43 may be placed over the set of SSL elements 30 to obtain the desired luminous distribution. Consequently, the provision of such spatially separated mirror-imaged lens portions in an optical device 40 ensures that the lamp 10 may generate the desired luminous distribution independent of its orientation in a luminaire.

The optical element 40 may be made of any suitable optical material, e.g. glass or an optical grade transparent plastics material such as polycarbonate, polyethylene terephtalate or poly (methyl methacrylate). The provision of the optical element 40 in an optical grade transparent plastics material is particularly suitable as in such a case the optical element 40 can be manufactured in a cost-effective manner, e.g. casting or molding.

Figure 10:
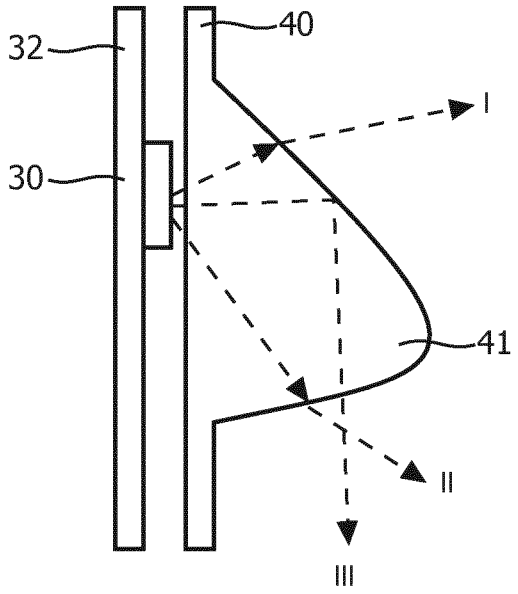
FIG. 10 schematically depicts an aspect of the optical device of FIG. 9 in more detail.

FIG. 10 schematically depicts an embodiment of the first lens portion 41 of the optical element 40, in which the first lens portion 41 is an asymmetric lens portion. It will be understood that the second lens portion 43 may have the mirror-imaged shape of the first lens portion 41 as previously explained. The first lens portion 41 is shaped such that the luminous output of the set of SSL elements 30 is shaped into three zones (labeled I, II and III respectively). This may be achieved by the first lens portion 41 refracting and/or reflecting incident rays of the light produced by the set of SSL elements 30. The desired optical performance of the first lens portion may be achieved by appropriately shaping the light exit surface of the first lens portion 41 and by selecting a lens material having an appropriate refractive index, as is well known per se.

Figure 11:
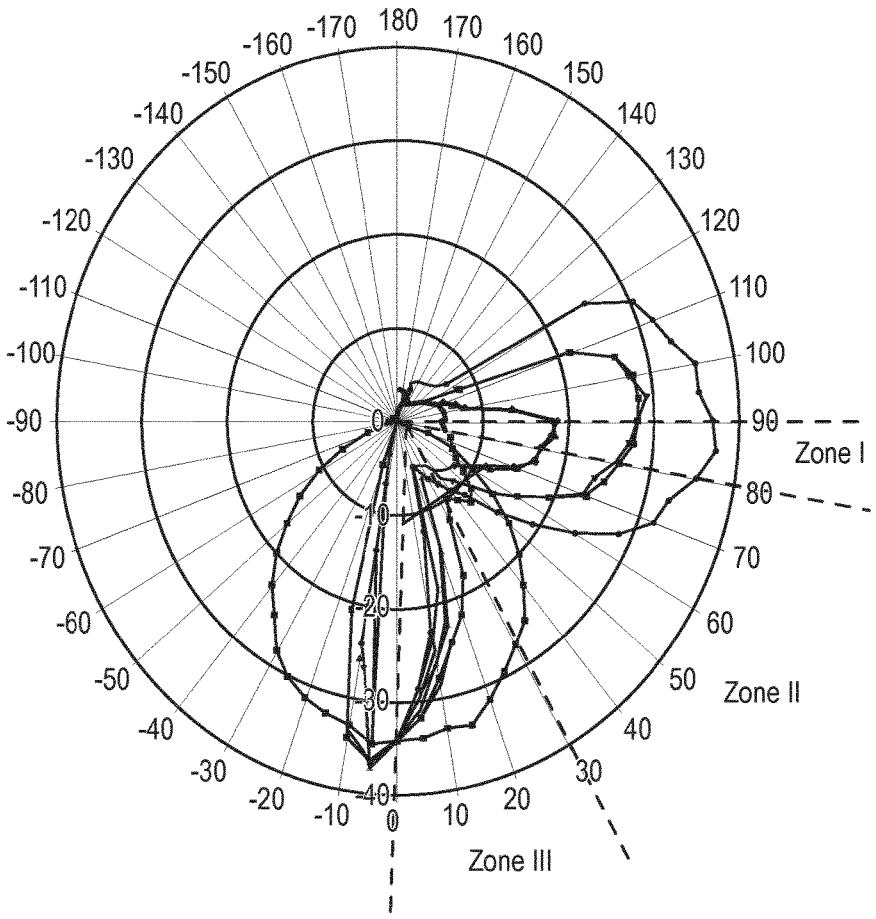
FIG. 11 is a polar plot of a light distribution of a lamp according to an embodiment in a particular configuration.

FIG. 11 is a polar plot of a light distribution produced by the asymmetric first lens portion 41, in which the three zones I-III are highlighted. As can be seen, a higher light intensity is achieved in zones I and III, whereas in zone II the light intensity is reduced compared to zones I and III. This light distribution can be seen to resemble a butterfly shape, in which zones I and III resemble the wings of the butterfly.

Figure 12:
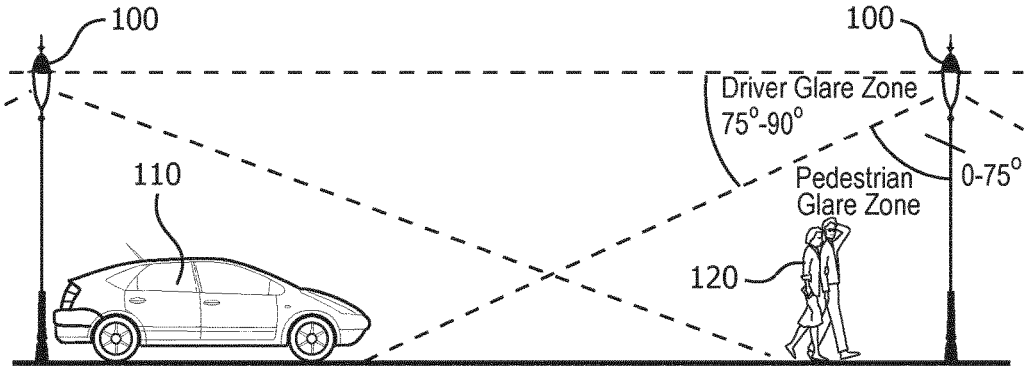
FIG. 12 schematically depicts the requirement for more comfortable light for pedestrians, and safety light for drivers.

Example embodiments of these zones will be further explained with the aid of FIG. 12, which schematically depicts an outdoor area illuminated by luminaries 100 including the lamp 10.

For example, the light in Zone I may be generated by refraction and may be used to illuminate an outdoor area such as a road relatively far away from the luminaire, i.e. generate light under angles close to 90° relative to a vertical axis such as a mounting pole of a luminaire 100, e.g. in a range of about 75-90°. Under such angles, glare is typically minimized such that a driver 110 is not blinded by a luminaire 100.

For example, the light in Zone II may be generated by reflection and may be used to illuminate an outdoor area such as a pedestrian walkway at intermediate distances from a luminaire 100, i.e. generate light under angles in a range of about 25-75° relative to the vertical axis. At these distances, pedestrians 120 may look directly at a luminaire 100 such that reducing the intensity of the luminous output in this zone reduces the risk that the pedestrians 120 perceive the light generated by a luminaire 100 as unpleasant, e.g. blinding.

For example, the light in Zone III may be generated by refraction and may be used to illuminate an outdoor area at short distances from a luminaire 100, i.e. generate light under angles in a range of about 0-25° relative to the vertical axis. At these distances, drivers 110 and pedestrians 120 are unlikely to look directly at a luminaire 100 such that in this zone the light may have a high intensity to achieve effective illumination of the area around the luminaire 100.

It is reiterated that the above ranges of zones I-III are by way of non-limiting example only and that other ranges may be contemplated without departing from the teachings of the present invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lamp for replacement of a HPS or HID lamp, comprising:

a support element including a mounting shaft extending therefrom, said mounting shaft being substantially parallel and having lateral displacement relative to a central axis of the lamp;

a plurality of modules each comprising a heat spreading element;

a plurality of sets of solid state lighting elements, wherein each set is mounted on an outer surface of one of said modules;

wherein at least one module is mounted on the mounting shaft and is rotatable about the mounting shaft such that said at least one module can be pivoted between:

a first orientation in which the modules cooperate to define a closed structure with an inner volume, which acts as a chimney structure through which a gas or a gas mixture can flow along the direction of the central axis of the lamp; and a second orientation in which the at least one module is pivoted away from at least one neighboring module to define an opened structure;

and a holder for holding the support element, said holder comprising a lamp cap to connect the lamp to a power source, wherein the lamp cap is compatible with a socket for the HPS or HID lamp to be replaced.

2. The lamp of claim 1, wherein in the second orientation the outer surface of the at least one module pivoted away from a neighboring module faces the same direction of the outer surface of the neighboring module.

3. The lamp of claim 1, wherein the least one module mounted on the mounting shaft has an edge portion comprising a mounting member mounted on the mounting shaft.

4. The lamp of claim 3, wherein a pair of modules are mounted on the mounting shaft such that the respective edge portions of said pair are facing each other.

5. The lamp of claim 1, wherein the outer surfaces are curved surfaces such that the closed structure has a substantially cylindrical shape.

6. The lamp of claim 1, further comprising a locking element for locking the at least one module mounted on the mounting shaft in the first or second orientation.

7. The lamp of claim 6, wherein:

the mounting shaft comprises a threaded end portion; and the locking element comprises a nut or screw for engaging with the threaded end portion.

8. The lamp of claim 1, wherein the support element comprises a pair of mounting shafts, wherein at least one module is rotatably mounted on each mounting shaft.

9. The lamp of claim 8, wherein the mounting shafts are offset by a same amount in opposite directions.

10. The lamp of claim 1, wherein each module further comprises an optical element adjustably mounted over the set of solid state lighting elements, wherein the optical element can be adjusted between a first position and a second position, said optical element comprising:

a first lens portion for directing the luminous output of the set of solid state lighting elements in a first direction in said first position; and a second lens portion spatially separated from the first lens portion for directing the luminous output of the set of solid state lighting elements in a second direction different to the first direction in said second position.

11. The lamp of claim 10, wherein the optical element is slidably mounted over the set of solid state lighting elements.

12. The lamp of claim 10, wherein at least one of the first lens portion and the second lens portion is an asymmetric lens portion.

13. The lamp of claim 12, wherein the asymmetric lens portion is shaped to generate a first luminous distribution portion and a second luminous distribution portion separated from the first luminous distribution portion by a third luminous distribution portion of lower intensity than the first and second luminous distribution portions.

14. An outdoor luminaire comprising the lamp of claim 1.

* * * * *